US005448776A

United States Patent [19]

Caruso

[11] Patent Number: 5,448,776

[45] Date of Patent: Sep. 12, 1995

[54] LIGHTWEIGHT BEAM MITT

[76] Inventor: Paul J. Caruso, 47 Church St., Ramsey, N.J. 07446

[21] Appl. No.: 135,903

[22] Filed: Oct. 13, 1993

[51] Int. Cl.[6] ..... A41D 13/08

[52] U.S. Cl. ..... 2/19; 2/161.1

[58] Field of Search ..... 2/19, 161.1, 167, 168; 273/25, 26 C

[56] References Cited

U.S. PATENT DOCUMENTS

| | | | |
|---|---|---|---|
| 3,409,010 | 11/1968 | Kron | 128/260 |
| 4,017,076 | 4/1977 | BAI | 273/102 R |
| 4,628,543 | 12/1986 | Hunt | 2/19 |
| 4,817,209 | 4/1989 | Lehmann et al. | 2/19 |
| 4,881,276 | 11/1989 | Swan . | |
| 4,896,376 | 1/1990 | Miner | 2/19 |
| 4,908,880 | 3/1990 | Clevenhagen | 2/19 |
| 4,986,681 | 1/1991 | Oliver . | |
| 4,996,721 | 3/1991 | Benshro | 2/19 |
| 5,085,442 | 2/1992 | Lee . | |

*Primary Examiner*—Clifford D. Crowder
*Assistant Examiner*—Larry D. Worrell, Jr.
*Attorney, Agent, or Firm*—Klauber & Jackson

[57] ABSTRACT

A lightweight, tear resistant sporting mitt for use on or adjacent to beaches and water. The mitt is water repellant and is unaffected by sand, while having sufficient structural strength to withstand heavy use with hard balls such as artificial baseballs. The mitt is formed from substantially congruent alternating planar layers of abuse resistant plastic coated canvas and resilient compressible porous or foam material (two outer layers of canvas, two layers of resilient compressible porous and a central canvas layer. The layers are peripherally sewn to each other, with an opening remaining, at the base of the mitt for hand insertion between resilient compressible porous layers. A hinge line for a ball catching pocket extends from the hand insertion opening to a webbing enclosed cut out section. A canvas webbing segment having a shape and size similar to the cut-out section is positioned in the cut-out area and is peripherally sewn to the edges of the cut-out section, while lateral segments of the mitt are hinged, towards each other, whereby a ball catching pocket is formed.

15 Claims, 3 Drawing Sheets

LIGHTWEIGHT BEAM MITT

FIELD OF THE INVENTION

This invention relates to gloves or mitts used in facilitating the playing of catching games and more particularly to such gloves or mitts used for playing games involving the catching of a ball in environments, such as at beaches, otherwise adverse to normally utilized catching type gloves.

BACKGROUND OF THE INVENTION

The standard glove or mitt utilized with the catching of balls in games such as softball, baseball and the like is generally made of leather and it serves the dual purpose of protecting the hand of the catcher and providing a greater reach for catching the ball. These leather gloves are suitably durable, whereby they can be used for extensive periods of time with hard objects, such as baseballs thrown at high speeds, without damage. Such leather gloves are however adversely affected by contact with sand and/or water and are not suitable for use at beaches or in similar environments.

Waterproof polyvinyl type plastic gloves, such as those made for children and for use with soft ball materials, are however, not durable, and tend to shred very rapidly when used with relatively hard balls.

SUMMARY OF THE INVENTION

Generally, the present invention comprises a tear resistant ball catching mitt, which is relatively impervious to adverse conditions such as sand and water, and is also suitable for use with hard balls such as artificial baseballs.

The mitt of the present invention is formed with an outer water-resistant fabric material shell and a resilient compressible porous material core which imparts both structural integrity to the mitt and cushioning against the effects of catching a hard ball. The fabric material shell and the resilient material core form a mitt structure comprising a ball-catching and enclosing pocket, comprised of an enclosing member having a hinged portion formed therein, and ball retaining means including a webbing element. The mitt further comprises hand control means, which encloses the operating hand whereby the thumb of the hand controls hinging of one side of the enclosing member and the other four fingers control hinging of the other side of the enclosing member. Optionally, an opening is included in the mitt to permit outside extension of the forefinger of the hand for greater catching stability.

The mitt is comprised of at least two layers of a plastic coated or otherwise waterproof-sealed durable and flexible fabric material such as commercially available Colonial ® (a trademark of Harold Davis Textile Corp. for its polyacrylic polyester coated canvas fabric) canvas, similar to fabric material commonly used in awnings and lawn furniture. Also utilizable are plastic fabrics having tear resistant strengths similar to that of fabrics. These layers provide the shell of the mitt.

The fabric layers are of substantially congruent shape and are preferably of an approximate square configuration, with height and width of about 12" (30.5 cm), with a peripheral cut-out section, preferably trapezoidal in shape, of an area of about 3×3" (7.6×7.6 cm). The webbing element, of the same material, appropriately shaped, completely or substantially completely covers the trapezoidal cut-out.

Interposed between the layers of the coated or sealed fabric material are at least two substantially congruous, though slightly smaller, layers of a resilient compressible porous material of sufficient thickness to provide structural integrity for the mitt. This porous material is an expanded rubberized or plastic compressible porous or foam material, such as polyurethane or expanded PVC. The pores are of a sufficiently small size to resist any substantial water absorption and the surfaces thereof are sufficiently densified to substantially totally resist water absorption. A particularly suitable material is commercially available Ensolite ® (a trademark of 9 North by Northwest Corp. for its expanded PVC material) foam commonly used as a cushioning material for sleeping bags. The outer layers of the fabric material peripherally enclose the foam material and interior fabric material layers, if any. The separate layers of both the fabric material and the foam material may also be suitably formed from a folded single layer, with the layers and congruencies described herein being relative to the mitt as fully constructed.

Since the shell of the mitt is made of a relatively soft fabric material, having no little or no structural integrity, as opposed to the harder, shape retaining leather of common gloves, used in playing baseball, it is necessary to provide means for shape retention. In accordance with the present invention, the foam material is of sufficient thickness and density to provide the requisite shape retention and structural integrity. In addition, in order to provide full structural integrity, the foam material should substantially completely fill the volume between at least two layers of the fabric material. To permit full volume filling by the foam material, it is desirable to form the mitt with the configuration of a substantially hollow scoop shape, with hinged sections, which is more readily fillable, rather than as a glove, with separate fingers.

In a preferred embodiment, with two or more layers of foam material, the foam layer furthest from the catching pocket is slightly wider than that of the foam layer(s) closest to the catching pocket, in order to impart a pocket catching curvature when the layers are peripherally attached. The foam layer closest to the pocket also provides the requisite cushioning protection from the hard balls being caught by the mitt and it should be thick enough for such purpose.

For durability and flexibility, it is also preferred that there be several layers of foam material, enclosed by the plastic coated or sealed fabric material. Total foam material thickness ranges from about ½" for minimal structural integrity to about ". Excessively thick foam material is however not desired because of loss of flexibility. Excessively thin foam material may lose both structural integrity and ability to provide the cushioning protection. The user's hand is inserted between the layers of foam material whereby there is an element of structural integrity on both sides of the hand for proper control of the mitt.

It is an object of the present invention to provide a ball catching glove or mitt, which can also be used at a beach, with substantial resistance to adverse conditions of water and sand.

It is a further object of the present invention to provide such mitt with structural integrity whereby it retains its shape, with utilizable flexibility.

It is a still further object of the present invention to provide the mitt with sufficient structural strength to withstand use with even hard regulation type baseballs under continued use.

These and other objects, features and advantages of the present invention will become more evident from the following discussion and drawings in which:

DETAILED DESCRIPTION OF THE INVENTION

Figure 1:
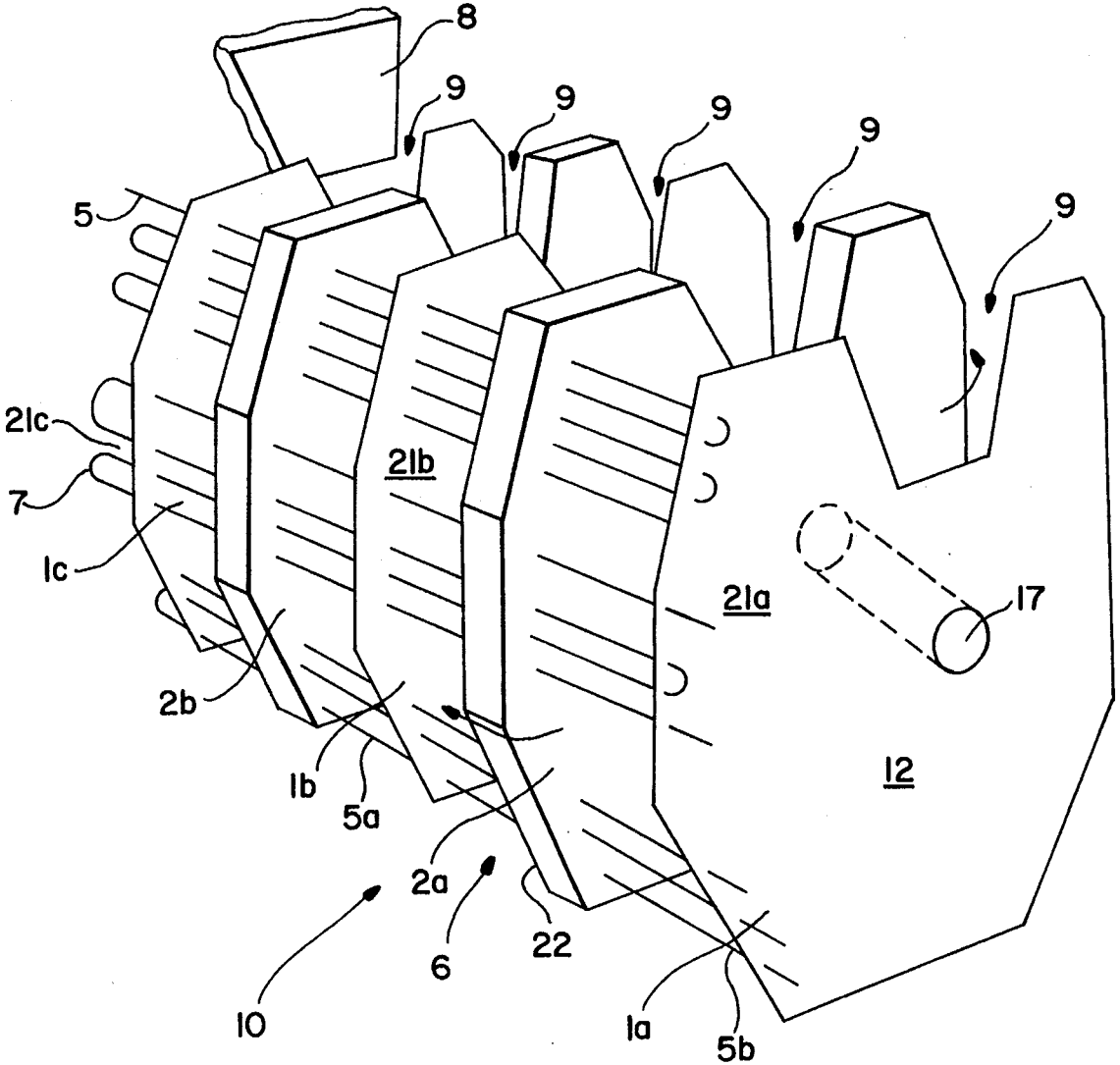
FIG. 1 is a blow up view of the various components of the mitt of an embodiment of the present invention.

The present invention comprises a light weight, tear resistant sporting mitt which is particularly useful in catching hard balls even in environments such as at or adjacent to beaches and water. The mitt is substantially water repellent and is unaffected by sand and water, while having sufficient structural strength to withstand heavy use with hard balls such as artificial baseballs. The mitt comprises at least two superimposed layers of a strong fabric material, particularly canvas, which has been waterproofed by means of a tear resistant plastic coating, layer or impregnation. Alternatively, a woven plastic fabric of comparable strength may be utilized.

In order to provide both structural integrity and cushioning protection, the core of the mitt is comprised of at least one layer of a foam material, such as Ensolite foam, which provides a degree of rigidity and structural integrity for the mitt. In addition, the foam material preferably has smooth, non-absorbent surfaces whereby it is resistant to water absorption from ambient conditions and from perspiration of the user's hand.

At least the outer two layers of the fabric material substantially peripherally enclose the foam material layers, to provide the mitt structure. The peripheral enclosure is preferably effected by stitching with heavy duty abuse resistant thread such as of nylon. If desired, such peripheral enclosure can be made with a piping hem. A fabric layer, with rigidifying foam layer, is positioned at the rear of the mitt structure with a bottom end being left open to permit hand insertion and manipulation of the mitt. To improve structural integrity, all the layers including the foam material are additionally peripherally stitched together, at least on opposing sides, with a heavy duty thread, without, of course, closing the end, left open for hand insertion.

In a preferred embodiment, the mitt is formed from substantially congruent alternating planar layers of abuse resistant plastic coated Colonial canvas and Ensolite foam (two outer layers of canvas, two layers of foam and a central canvas layer), with each layer having an inverted trapezoidal base, integral with a substantially rectangular upper portion. The outer layer of the foam material is slightly wider than the other foam material layer, to impart a pocket forming curvature when they are peripherally attached. The two outer canvas layers are slightly larger than the other layers for overall enclosure of the core foam material. With connection by stitching together of the various layers in this embodiment, two members are formed. The first member is comprised of a foam material layer enclosed by two layers of the canvas material, and this member comprises the ball catching or pocket element of the mitt. The second member which retains an inserted hand, comprises a layer of foam material (slightly wider than the foam material layer in the first member) connected to a layer of canvas material. The two members are in turn connected to each other along three of their four sides, with the fourth side being left open, at the base of the inverted trapezoidal base, for hand insertion between the two members.

An inverted trapezoidal cut-out section extends from the top of the upper portion towards the inverted trapezoidal base, for a distance of about one third of the rectangular upper portion, with the cut-out being positioned off the center line of the longitudinal axis. The base inverted trapezoidal configuration provides for greater hand control while the rectangular upper portion configuration provides for greater catching area.

A line extends between the base of the trapezoidal cut-out and the trapezoidal base, defining a hinge line for the mitt. The hinge line is formed by compression (of the foam layer) such as by heat compression, or stitching (excluding the layer(s) providing the pocket opening for the hand) to facilitate hinging. Alternatively, segmented sections of foam may be utilized wherein the separation between segments coincides with the hinge line. The hinge line falls across the user's palm in setting off the thumb from the other fingers and is preferably located near the other fingers, for greater hand control.

A canvas or similar fabric webbing segment having a shape and size similar to the cut-out section is positioned in the cut-out area and is peripherally sewn to the edges of the cut-out section, while lateral segments of the mitt are hinged, towards each other, whereby a ball catching pocket is formed. For added strength, the webbing segment is at least a two ply canvas element. The webbing segment may either be a unitary member which completely covers the trapezoidal cut-out, or it may comprise a plurality of strap members to connect the lateral segments together in the formation of a pocket. With the formation of the pocket, the typical approximate foot square dimensions of the mitt takes on an overall approximate 11"×7" configuration with an easily manipulable weight of about four ounces, in the preferred embodiment described. In the preferred embodiment, a scooped portion of the mitt, below the web section and facing it, is stitched to extend the depth of a pocket. This scooped portion is particularly effective in retaining rubberized balls in the mitt, having a surface material with a relatively low coefficient of friction (plastic coated fabric).

DETAILED DESCRIPTION OF THE DRAWINGS AND THE PREFERRED EMBODIMENT

Figure 2:
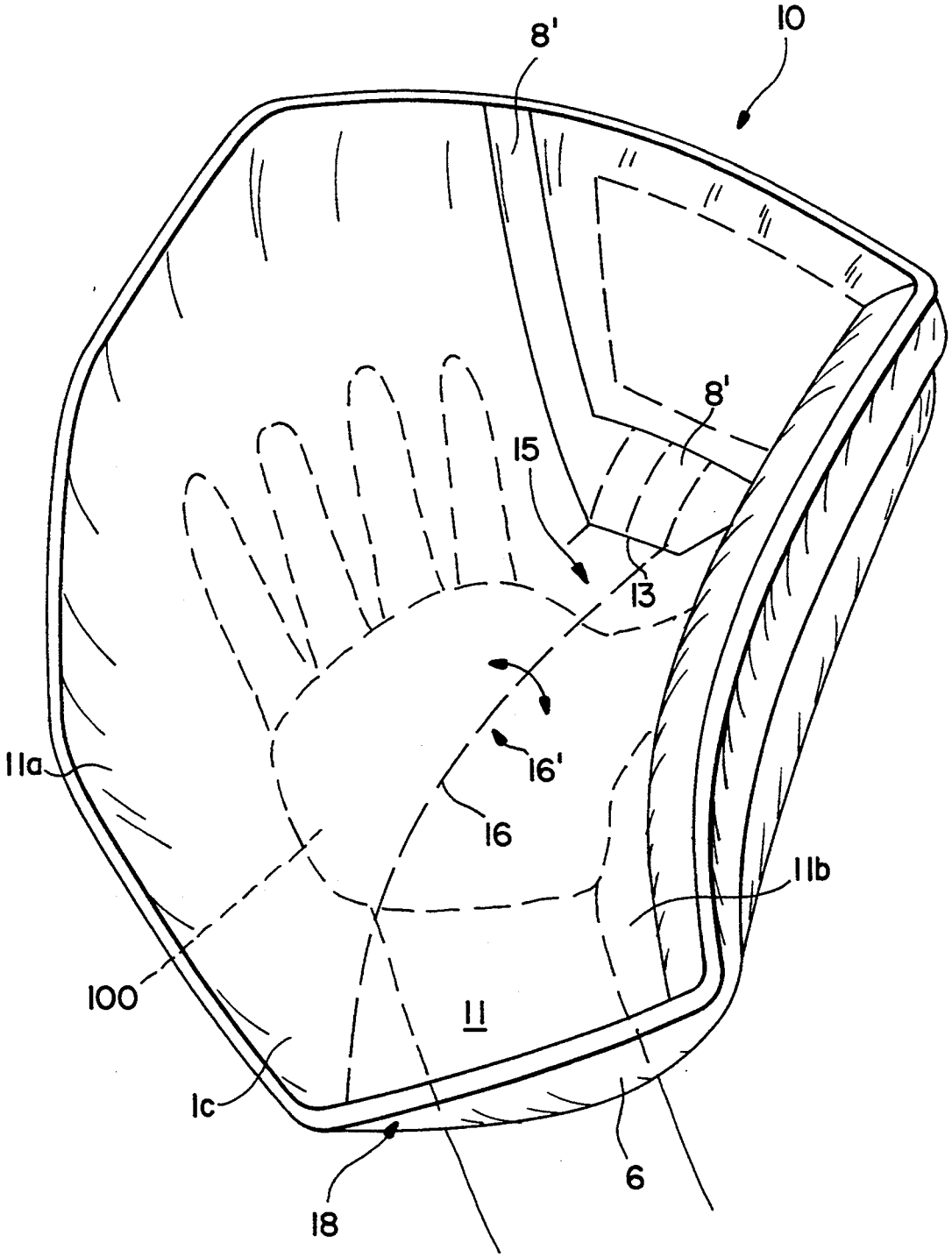
FIG. 2 is an isometric view of the embodiment of FIG. 1 after the components have been joined together.
Figure 3:
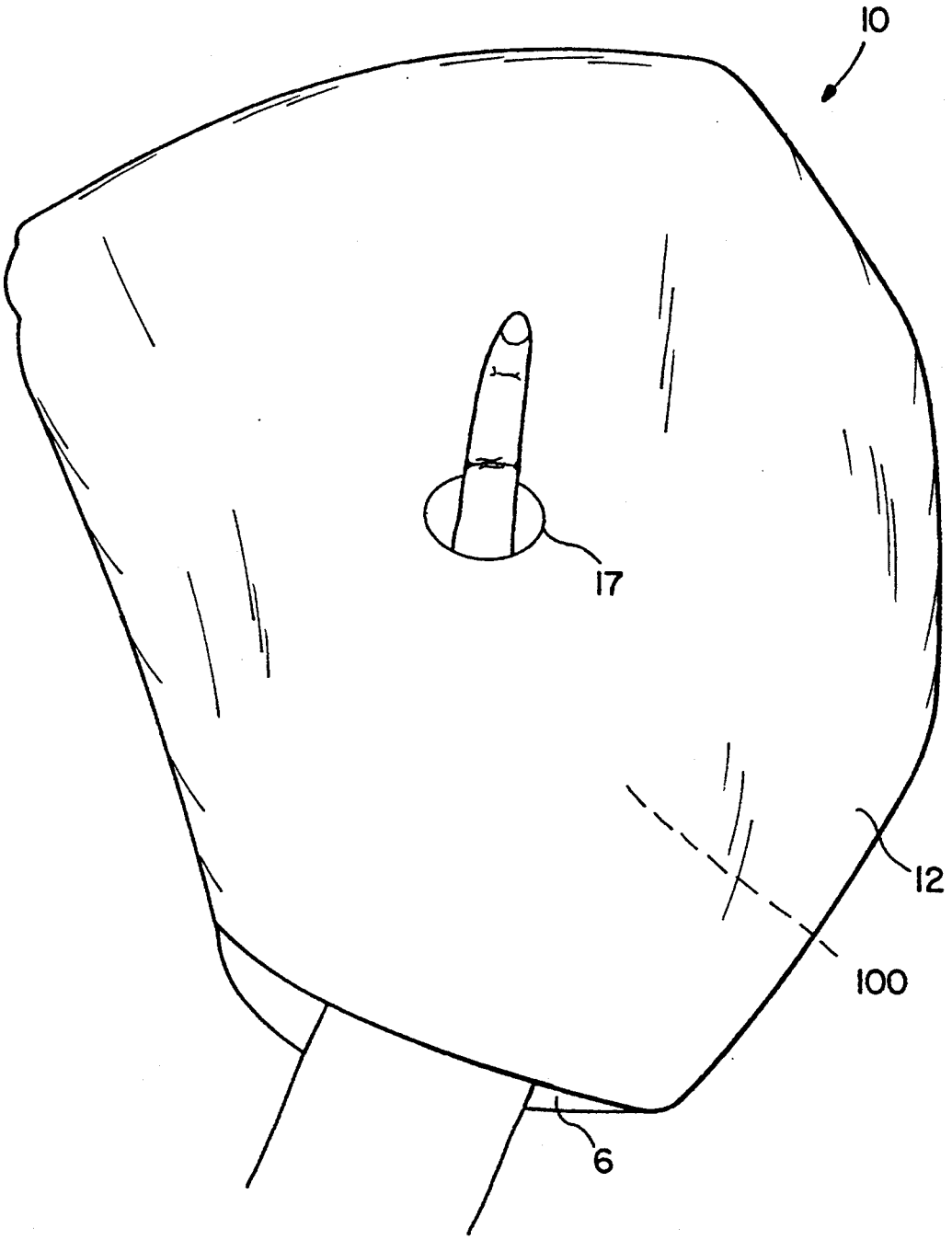
FIG. 3 is a rear view of the mitt of FIG. 2, showing the opening for exterior placement of the index or forefinger.

With specific reference to the drawings, in FIG. 1, mitt 10 is shown, in exploded view, with its components of substantially congruent shaped plastic coated canvas layers 1*a*, 1*b*, and 1*c* interleaved with ½" thick Ensolite foam layers 2*a* and 2*b*. Canvas layer 1*a* forms the back 12 of the mitt 10, as shown in FIGS. 2 and 3, and canvas layer 1*c* forms the pocket 15 of the mitt 10.

Stitching 5, comprised of nylon thread, peripherally laterally connects all of the respective layers together. Stitching 5*a* and 5*b*, of the same nylon material, continue the peripheral lateral stitching 5 to interconnect layers 1b, 1c with layer 2b therebetween, to form ball catching pocket member 15 and layer la with layer 2a to form back hand member 12. A recess 6, for hand insertion, is formed between the two separate stitched together members 11 and 12. Foam layer 2a, is slightly wider than foam layer 2b, to help form the pocket 15, shown in FIG. 2. Outer canvas layers 1a and 1c are peripherally larger than the remaining canvas and foam layers and are separately stitched together with stitching 7 to peripherally enclose central or core layers 2a, 2b and 1b.

Two-ply canvas webbing 8 is fitted to the inner edges of cut-out 9 and stitched thereto, with stitching 8', to provide catching pocket 15. Scoop shaped stitching 13 (through all of layers 1a–c and 2a–b) extends the depth of catching pocket 15, thereby facilitating the capture of resilient or rubberized balls within the pocket 15, prior to bounce-out.

Hinge stitch 16 (through layers 1b, 1c and 2b) extending between pocket 15 and heel 18, compresses foam layer 2b to an extent sufficient to define a hinge 16' about which, lateral members 11a and 11b move, to enclose a ball caught within pocket 15. As shown, for greater control, the hinge stitch 16 is adjacent lateral member 11a, which is controlled by the finger of the hand 100 opposite the thumb.

Upon insertion of a user's hand 100, as shown in FIG. 2 and 3, the palm of the hand engages canvas layer 1b and the back of the hand engages non absorptive surface 22 of foam layer 2a. Though the canvas layers 1a, 1b and 1c are covered with waterproof plastic surfaces 21a, 21b, and 21c respectively, such surfaces retain a degree of roughness, which the palm of hand 100 can readily tolerate but which may irritate the back of the hand. Accordingly, engagement of the back of the hand with a foam layer is preferred for greater user comfort.

As shown in FIG. 3, the user's hand is completely enclosed within the mitt 10, and as shown in phantom, the thumb of hand 100 controls lateral section 11a and the other fingers control lateral section 11b on either side of the hinge 16'. For greater control, mitt 10 is provided with forefinger egress hole 17 through which the forefinger of hand 100 extends, to impart a back-up control of pocket 15.

It is preferred that the fabric material and the foam material be washable such that the mitt can be readily cleaned by placement in a washer and then a dryer.

It is understood that the above description and drawings are illustrative of the present invention and that changes may be made in component materials and structure without departing from the scope of the present invention as defined in the following claims.

What is claimed is:

1. A water resistant mitt suitable for ball-catching, said water resistant mitt comprising:

an enclosing member having a hinged portion formed therein for separating two sides thereof, wherein the thumb of a hand controls a hinging movement for a first side of said enclosing member, and wherein the other fingers of a hand control a hinging movement for a second side of said enclosing member, said enclosing member comprising at least two layers of a water resistant, flexible fabric material and at least two layers of a resilient, compressible porous material all having substantially congruent shapes, said layers of water resistant, flexible fabric material and said layers of resilient, compressible porous material each having a peripheral cut out of substantially congruent shape, said layers of resilient, compressible porous material being superimposed with and positioned between said layers of water resistant, flexible fabric material, wherein the outer layers of said water resistant, flexible fabric material substantially peripherally enclose said layers of resilient, compressible porous material, and wherein said layers of resilient, compressible porous material provide structural integrity to said mitt; and ball retaining means comprising a separate webbing member, said separate webbing member being attached to said enclosing member in the area of said peripheral cut outs, wherein said separate webbing member substantially covers the area of said peripheral cut outs, and wherein said separate webbing member holds together said two sides of said enclosing member.

2. The water resistant mitt of claim 1, wherein said layers of resilient, compressible porous material substantially completely fill spaces between said layers of water resistant, flexible fabric material.

3. The water resistant mitt of claim 2, wherein said water resistant, flexible fabric material is comprised of canvas having a water resistant plastic coating thereon.

4. The water resistant mitt of claim 3, wherein said resilient, compressible porous material is comprised of a member of the group consisting of polyurethane and expanded PVC.

5. The water resistant mitt of claim 4, wherein said resilient, compressible porous material comprises expanded PVC having substantially non-porous surfaces.

6. The water resistant mitt of claim 3, wherein all of said layers of water resistant, flexible fabric material and resilient, compressible porous material are superimposed with each other and are peripherally attached to each other.

7. The water resistant mitt of claim 6, wherein said mitt comprises a ball catching member and a hand retaining member, wherein both said ball catching and hand retaining members comprise at least one of said layers of water resistant, flexible fabric material attached to at least one of said layers of resilient, compressible porous material, wherein said ball catching member and said hand retaining member are of substantially congruent shape, are superimposed on each other, and are peripherally attached, with an opening in said peripheral attachment sufficient for insertion of a hand between said ball catching member and said hand retaining member.

8. The water resistant mitt of claim 7, wherein said resilient, compressible porous layer of said hand retaining member is of greater width, across said inserted hand, than said resilient, compressible porous layer of said ball catching member, wherein, with the peripheral attachment of the members, said resilient, compressible porous layer of said hand retaining member imparts a curvature to said ball catching member, which comprises said ball retaining means.

9. The water resistant mitt of claim 8, wherein said hinged portion is formed by compressing said layers of resilient, compressible porous material along a line in said ball catching member extending from the area of said peripheral cut outs to said hand insertion opening, and wherein said hinged portion crosses an inserted hand so as to separate the thumb from the other fingers of said inserted hand.

10. The water resistant mitt of claim 9, wherein said hinged portion is closer to the other fingers than to the thumb of said hand.

11. The water resistant mitt of claim 11, wherein said hinged portion is formed by compressing said resilient, compressible porous layers with stitching.

12. The water resistant mitt of claim 10, wherein said hinged portion is formed by compressing said resilient, compressible porous layers with heat compression.

13. The water resistant mitt of claim 10, wherein said layers of water resistant, flexible fabric material and said layers of resilient, compressible porous material are stitched in a scoop shape adjacent to and facing the area of said peripheral cut outs and positioned between said hand insertion opening and the area of said peripheral cut outs so as to extend said ball retaining means.

14. The water resistant mitt of claim 13, wherein said hand retaining member is apertured to permit outward extension of a forefinger of an inserted hand.

15. The water resistant mitt of claim 14, wherein said ball catching member comprises one of said layers of resilient, compressible porous material positioned between two of said layers of flexible fabric material so that the front of an inserted hand engages one of said two flexible fabric layers and the back of an inserted hand engages said resilient compressible porous layer of said hand retaining member.

* * * * *

UNITED STATES PATENT AND TRADEMARK OFFICE

CERTIFICATE OF CORRECTION

PATENT NO. : 5,448,776

DATED : SEPTEMBER 12, 1995

INVENTOR(S) : PAUL J. CARUSO

It is certified that error appears in the above-indentified patent and that said Letters Patent is hereby corrected as shown below:

On the title page, item [54], and Column 1,
PLEASE CHANGE "BEAM" to — BEACH —.

Signed and Sealed this

Ninth Day of January, 1996

Bruce Lehman

*Attest:*

BRUCE LEHMAN

*Attesting Officer*

*Commissioner of Patents and Trademarks*